US009873607B1

(12) United States Patent
Midnight

(10) Patent No.: US 9,873,607 B1
(45) Date of Patent: Jan. 23, 2018

(54) FIVE-GALLON WATER SUPPLY SYSTEMS

(71) Applicant: John Wayen Midnight, Sherwood Park (CA)

(72) Inventor: John Wayen Midnight, Sherwood Park (CA)

( * ) Notice: Subject to any disclaimer, the term of this patent is extended or adjusted under 35 U.S.C. 154(b) by 0 days.

(21) Appl. No.: 15/222,921

(22) Filed: Jul. 28, 2016

(51) Int. Cl.
*B67D 1/08* (2006.01)
*B67D 3/00* (2006.01)
*B67D 7/62* (2010.01)

(52) U.S. Cl.
CPC ..... *B67D 3/0035* (2013.01); *B67D 3/0054* (2013.01); *B67D 3/0061* (2013.01); *B67D 7/62* (2013.01)

(58) Field of Classification Search
CPC .... B65D 21/00; B65D 21/02; B65D 21/0209; B65D 21/023; B65D 21/0231; B65D 88/022; B65D 88/027; B67D 3/0035; B67D 3/0054; B67D 3/0061; B67D 7/62
See application file for complete search history.

(56) References Cited

U.S. PATENT DOCUMENTS 1,954,261 A * 4/1934 Pierce ..... D06F 33/06 137/240
3,015,419 A * 1/1962 Arnett ..... B67D 1/0007 137/571
3,845,787 A * 11/1974 Slagle ..... B67D 1/102 137/571
4,148,731 A 4/1979 Brigante
5,163,587 A * 11/1992 Apps ..... B65D 21/0212 206/505
8,104,501 B1 * 1/2012 Ness ..... E21B 33/0355 137/259
9,216,890 B1 * 12/2015 Daniels ..... B67D 7/04
9,580,296 B2 * 2/2017 Daniels ..... B67D 7/78
2008/0314807 A1 * 12/2008 Junghanns ..... B01D 61/025 210/85

(Continued)

FOREIGN PATENT DOCUMENTS

CA 1286932 7/1991
CN 102745934 10/2012

(Continued)

*Primary Examiner* — Frederick C Nicolas
*Assistant Examiner* — Bob Zadeh
(74) *Attorney, Agent, or Firm* — Integrity Patent Group, PLC; Edwin Wold

(57) ABSTRACT

A five-gallon water supply system for controlling flow of liquids under gravity from storage containers for dispensing purposes. The system may have at least one water reservoir interface, at least one expandable plumbing assembly, and at least one platform. The at least one water reservoir interface may have a first water reservoir interface, second, third, fourth, and last water reservoir interface. The expandable plumbing assembly may be hydraulically coupled to the first water reservoir interface and the last water reservoir interface. The expandable plumbing assembly may be configured to plumb potable water from to a single water outlet. The platform may include a first water bottle stand, which may be removably coupled together with a last water bottle stand. The platform further may include a second, third, and fourth water bottle stand that are removably coupled with the first water bottle stand and the last water bottle stand.

17 Claims, 5 Drawing Sheets

(56) References Cited

U.S. PATENT DOCUMENTS

| | | | | |
|---|---|---|---|---|
| 2015/0014245 | A1 | 1/2015 | Rogelio et al. | |
| 2015/0246804 | A1* | 9/2015 | Fracassi ..... | B67D 1/06 222/129.1 |
| 2016/0016828 | A1 | 1/2016 | Vivian | |

FOREIGN PATENT DOCUMENTS

| | | |
|---|---|---|
| CN | 202511373 | 10/2012 |
| CN | 202762212 | 3/2013 |
| CN | 203955600 | 11/2014 |

* cited by examiner

FIVE-GALLON WATER SUPPLY SYSTEMS

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of devices for controlling flow of liquids under gravity from storage containers for dispensing purposes and more specifically relates to a five-gallon water supply system.

2. DESCRIPTION OF RELATED ART

Consumers choose bottled water as an alternative to other packaged beverages because it does not have calories, caffeine, sugar, artificial flavors or colors, alcohol or other ingredients they may wish to moderate or do not wish to ingest as they hydrate their bodies with the water. Consumers may also choose bottled water because they are not always satisfied with the aesthetic qualities (e.g., taste, odor, color) or the purity of their tap water. In addition, bottled water is not only used for drinking, it may be used to prepare coffee or tea, as well as be used for cooking purposes.

Many consumers have a water dispenser for bottled water. In this case, five-gallon water bottles are delivered to a home or business. The water bottles are stored until needed. When the water bottle on the water dispenser is empty, the water bottle is removed and replaced with a full water bottle. In a home or a business with numerous people accessing the bottled water, the empty bottles may need to be frequently replaced and may be disruptive. A suitable solution is desired.

Several attempts have been made to solve the above-mentioned problems such as those found in U.S. Pat. No. 4,148,731 to Brigante; 2016/0016828 to Vivian; 2015/0014245 to Rogelio et al.; Canadian Pat. No. 1,286,932 to Adams; Chinese Pat. Nos. 102,745,934 to Yi, et al.; 202,511,373 to Ho; 203,955,600 to Xiang, et al.; and 202,762,212 to Hombori. This art is representative of devices for controlling flow of liquids under gravity from storage containers for dispensing purposes. However, none of the above inventions and patents, taken either singly or in combination, is seen to describe the invention as claimed.

Preferably, a device for controlling flow of liquids under gravity from storage containers for dispensing purposes should provide an on-demand gravity-fed water dispenser and, yet would operate reliably and be manufactured at a modest expense. Thus, a need exists for a reliable five-gallon water supply system to avoid the above-mentioned problems.

BRIEF SUMMARY OF THE INVENTION

In view of the foregoing disadvantages inherent in the known devices for controlling flow of liquids under gravity from storage containers for dispensing purposes art, the present invention provides a novel on-demand gravity-fed water dispenser. The general purpose of the present invention, which will be described subsequently in greater detail is to provide a five-gallon water supply system.

The five-gallon water supply system is a system for delivering water and may comprise at least one water reservoir interface, at least one expandable plumbing assembly, and at least one platform. The at least one water reservoir interface may comprise a first water reservoir interface, a second water reservoir interface, a third water reservoir interface, a fourth water reservoir interface, and a last water reservoir interface. The at least one water reservoir interface may be configured to hydraulically couple with a first water bottle. The second water reservoir interface configured to hydraulically couple with the second water bottle, and the second water reservoir interface may be at a higher elevation than the first water reservoir interface. The third water reservoir interface may be configured to hydraulically couple with the third water bottle, and the third water reservoir interface may be at a higher elevation than the second water reservoir interface. The fourth water reservoir interface configured to hydraulically couple with the fourth water bottle, and the fourth water reservoir interface at a higher elevation than the third water reservoir interface. The last water reservoir interface may be configured to hydraulically couple with a last water bottle, the last water reservoir interface at a higher elevation than the first water reservoir interface. The first water bottle and the last water bottle are preferably standard 4-gallon drinking water bottles.

The expandable plumbing assembly may be hydraulically coupled to the first water reservoir interface and to the last water reservoir interface. The expandable plumbing assembly may be configured to plumb potable water from the first water bottle and from the last water bottle to a single water outlet. The drain may be configured with an electrically-powered on-demand pump to transfer the potable water to a distribution point for consumption.

Further, the expandable plumbing assembly may include an air vent, with the air vent having a higher elevation than the last water reservoir interface. The expandable plumbing assembly may be also hydraulically coupled to the second water reservoir interface, the third water reservoir interface, and the fourth water reservoir interface in series. The expandable plumbing assembly may be further configured to plumb potable water from the second water bottle, the third water bottle, and the fourth water bottle to the single water outlet. The expandable plumbing assembly has a first interconnecting tube joining the first water reservoir interface to a water-flow assembly. The second interconnecting tube may join the second water reservoir interface to the water-flow assembly, a third interconnecting tube may join the third water reservoir interface to the water-flow assembly, a fourth interconnecting tube may join the fourth water reservoir interface to the water-flow assembly, and a last interconnecting tube may join the last water reservoir interface to the water-flow assembly. The water-flow assembly has a lower elevation at the single water outlet and a higher elevation at the last water bottle stand. The water-flow assembly may be configured of tubing having threaded connections. Other means may be employed.

The platform may include a first water bottle stand, which may be removably coupled together with a last water bottle stand. The platform further may include a second water bottle stand, a third water bottle stand, and a fourth water bottle stand that are removably coupled together and to the first water bottle stand and to the last water bottle stand. The first water bottle stand may be may configured to support the first water bottle at a first elevation. The second water bottle stand may be configured to support the second water bottle at a second elevation, the third water bottle stand may be configured to support the third water bottle at a third elevation, and the fourth water bottle stand may be configured to support the fourth water bottle at a fourth elevation, respectively. As such, the last water bottle stand may be may be configured to support the last water bottle at a last elevation that may be higher than the first elevation.

The last water bottle stand may include a basic stand and a last riser, the basic stand being substantially similar to the first water bottle stand, and the last riser may be configured to elevate the last water bottle by a last increment; the last increment being the difference between the last elevation and the first elevation. The platform may be configured to hold five 5-gallon water bottles in a single line. The platform further comprises a plurality of adjustable legs forming a rectangular vertical-base which may be lengthened or shortened to provide a level surface. The rectangular vertical-base has an upper-platform surface, which may be configured in a square shape and sized to accommodate the outer circumference of standard 5-gallon drinking water bottles. The rectangular vertical-base may be configured at least partially of durable metal materials capable of bearing substantial weight.

The five-gallon water supply system may comprise a kit including: at least one water reservoir interface, at least one expandable plumbing assembly, at least one platform, and a set of user instructions.

A method of using a five-gallon water supply system may comprise the steps of: assembling at least one water reservoir interface, at least one expandable plumbing assembly, and at least one platform; installing at least one 5-gallon water bottle; actioning an electrically-powered on-demand pump to transfer the potable water to a distribution point for consumption; and replacing the at least one 5-gallon water bottle as desired; further disassembling the at least one water reservoir interface, the at least one expandable plumbing assembly, and the at least one platform as desired.

The present invention holds significant improvements and serves as a five-gallon water supply system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, five-gallon water supply system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a device for controlling flow of liquids under gravity from storage containers for dispensing purposes and more particularly to a five-gallon water supply system as used to improve an on-demand gravity-fed water dispensing means.

Generally speaking, the five-gallon water supply system is an easy-to-use water supply for a home, an office, or an event where standard sized five-gallon bottles are lined up in a row at different elevations. As water is dispensed, the gravity of the water will individually empty a water bottle and when that bottle is empty, the flow continues without stopping from the next five-gallon bottle in the series. The system can be re-filled at anytime with out stopping the flow of water. Water can be sent to any outlet that is supplied such as a faucet, refrigerator, coffee maker, water fountain, chiller or water heater tank using an on-demand pump. The system may be set up near the water bottle delivery and storage area, such as a home garage or an office storage room.

To use, the five-gallon bottles are opened and put into place on stands that are about 30 inches off the ground. Each stand will have spacer that increases the height of the stand by one inch. For example the first stand 30 inches high; with the spacer installed, the second stand 31 inches high and so on. By doing this the five gallon bottles at the highest point will empty before the next lower bottle, thus allowing both an endless flow of water and the ability to keep filling the system. The stands for the five-gallon water bottles are all the same size and have an elevation of 24 inches off the ground. They are 15 by 15 inches square. A single installation may accommodate up to 24 stands and may be connected to an additional installation for a total of 48 water bottles. The stands can be made out of hard plastic, wood, or metal with four legs to hold up the risers and water bottles. In an alternative embodiment, the water bottles may be suspended with wall brackets on a vertical planar surface if the stands are not desired.

Figure 1:
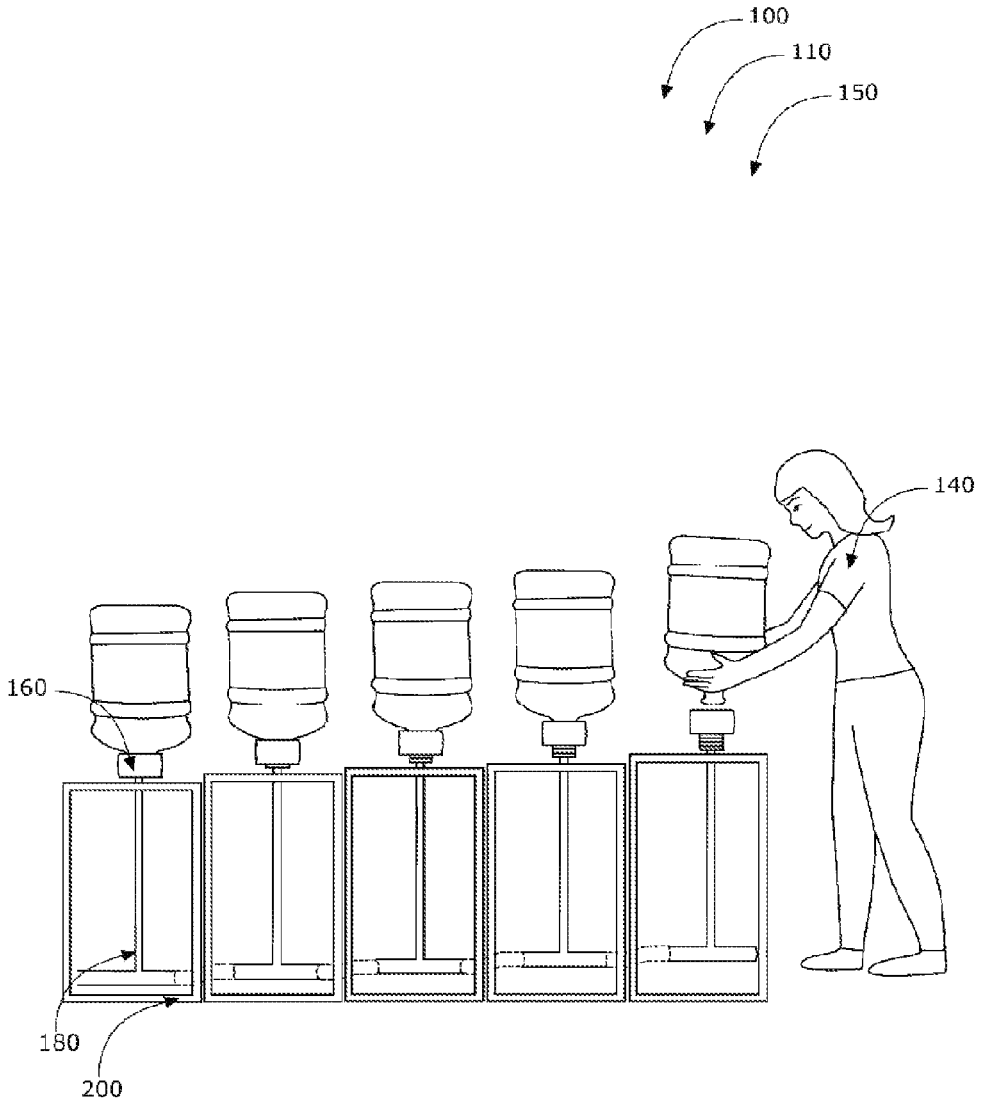
FIG. 1 shows a perspective view illustrating a five-gallon water supply system during an 'in-use' condition showing five-gallon water supply assembly according to an embodiment of the present invention.

Referring to the drawings by numerals of reference there is shown in FIG. 1, five-gallon water supply system 100 having user 140 adding last water bottle 170 (FIG. 2) during an 'in-use' condition 150. The system for delivering water 110 may comprise at least one water reservoir interface 160, at least one at least one expandable plumbing assembly 180, and at least one platform 200, useful for transferring potable water to a distribution point for consumption.

Figure 2:
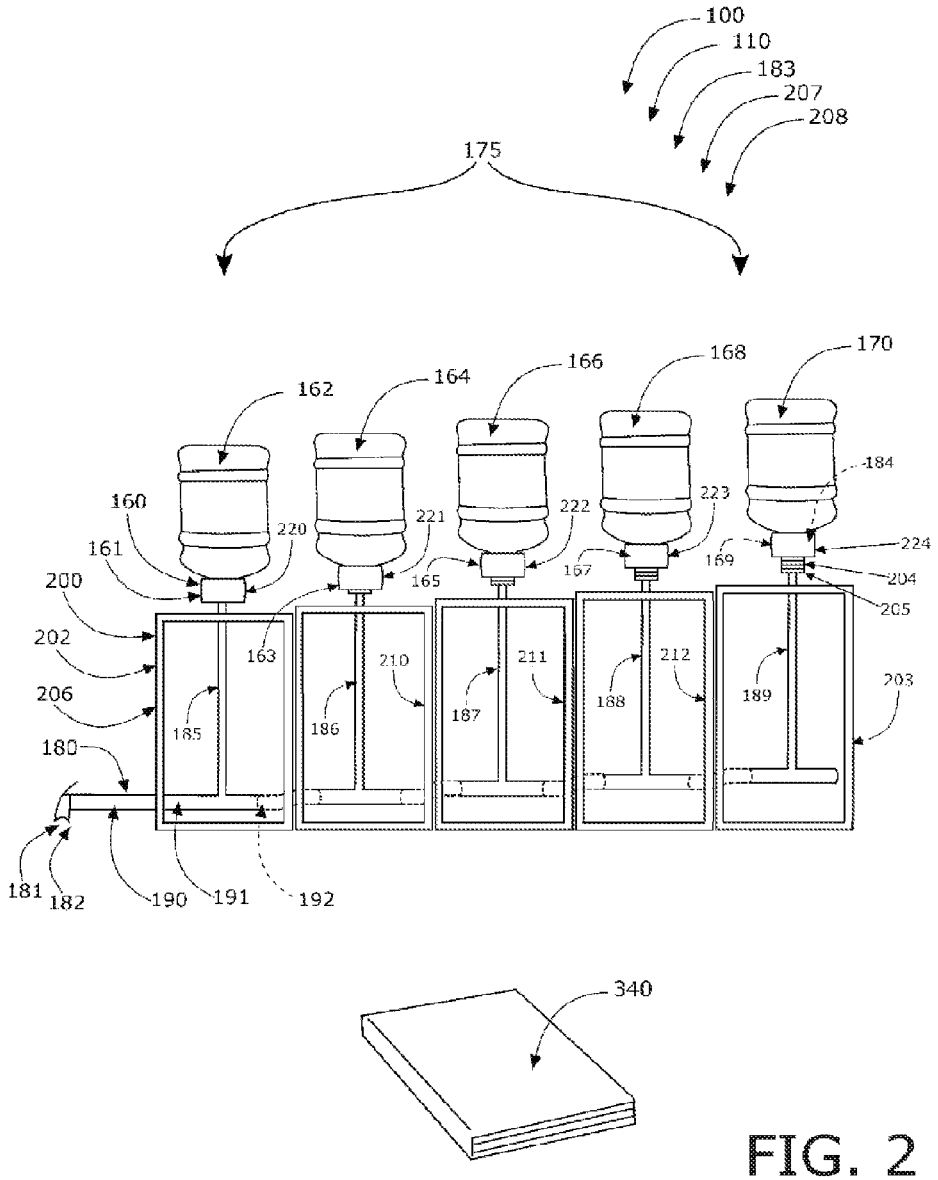
FIG. 2 is a perspective view illustrating the five-gallon water supply system comprising a five-gallon water supply assembly according to an embodiment of the present invention of FIG. 1.

Referring now to FIG. 2, showing system for delivering water 110 which may comprise at least one water reservoir interface 160 may further comprise a first water reservoir interface 161, second water reservoir interface 163, third water reservoir interface 165, fourth water reservoir interface 167, and last water reservoir interface 169. At least one water reservoir interface 160 may be configured to hydraulically couple with first water bottle 162. Second water reservoir interface 163 may be configured to hydraulically couple with second water bottle 164, and second water reservoir interface 163 may be at a higher elevation than first water reservoir interface 161. Third water reservoir interface 165 may be configured to hydraulically couple with third water bottle 166, and third water reservoir interface 165 may be at a higher elevation than second water reservoir interface 163. Fourth water reservoir interface 167 may be configured to hydraulically couple with fourth water bottle 168, and fourth water reservoir interface 167 may be at a higher elevation than third water reservoir interface 165. Last water reservoir interface 169 may be configured to hydraulically couple with last water bottle 170, and last water reservoir interface 169 may be at a higher elevation than first water reservoir interface 161. Further, first water bottle 162 and the last water bottle 170 are standard 5-gallon drinking water bottles 175.

In continuing to refer to FIG. 2, at least one expandable plumbing assembly 180 may be hydraulically coupled to first water reservoir interface 161 and to last water reservoir interface 169. At least one expandable plumbing assembly 180 may be configured to plumb potable water from first water bottle 162 and from last water bottle 170 to single water outlet 181. Single water outlet 181 may be configured to interface with drain 182 to provide an exit point to release potable water from at least one expandable plumbing assembly 180. Drain 182 may be configured with electrically-powered on-demand pump 183 to transfer potable water to a distribution point for consumption.

In further referring to FIG. 2, at least one expandable plumbing assembly 180 may include air vent 184, with air vent 184 having a higher elevation than last water reservoir interface 169. At least one expandable plumbing assembly 180 may also be hydraulically coupled to second water reservoir interface 163, third water reservoir interface 165, and fourth water reservoir interface 167. At least one expandable plumbing assembly 180 may be further configured to plumb potable water from second water bottle 164, third water bottle 166, and fourth water bottle 168 to single water outlet 181. At least one expandable plumbing assembly 180 may have first interconnecting tube 185 joining first water reservoir interface 161 to water-flow assembly 190. Second interconnecting tube 186 may join second water reservoir interface 163 to water-flow assembly 190, third interconnecting tube 187 may join third water reservoir interface 165 to water-flow assembly 190, fourth interconnecting tube 188 may join fourth water reservoir interface 167 to the water-flow assembly 190, and last interconnecting tube 189 may join last water reservoir interface 169 to water-flow assembly 190. Further, water-flow assembly 190 has a lower elevation at the single water outlet 181 and a higher elevation at the last water bottle stand 203. The water-flow assembly 190 may be configured of tubing 191 having threaded connections 192.

In continuing to refer to FIG. 2, platform 200 may include first water bottle stand 202, which may be removably coupled together with last water bottle stand 203. Platform 200 further may include second water bottle stand 210, third water bottle stand 211, and fourth water bottle stand 212 that may be removably coupled together and to first water bottle 162 stand and to last water bottle 170 stand. First water bottle stand 202 may be configured to support first water bottle 162 at first elevation 220. Second water bottle stand 210 may be configured to support the second water bottle 164 at second elevation 221, third water bottle stand 211 may be configured to support third water bottle 166 at third elevation 222, and fourth water bottle stand 212 may be configured to support fourth water bottle 168 at fourth elevation 223. Last water bottle stand 203 may be configured to support last water bottle 170 at last elevation 224 that may be higher than first elevation 220.

Further, last water bottle stand 203 may include basic stand 201 and last riser 204, with basic stand 201 being substantially similar to first water bottle stand 202, and last riser 204 may be configured to elevate last water bottle 170 by last increment 205, with last increment 205 being the difference between last elevation 224 and first elevation 220. Platform 200 may be configured to hold five standard 5-gallon water bottles 175 in a single line. Further, platform 200 may further comprise plurality of adjustable legs 206 forming a rectangular vertical-base 207 which may be lengthened or shortened to provide a level surface. Rectangular vertical-base 207 may be configured at least partially of durable metal materials 208 capable of bearing substantial weight.

It should be noted that five-gallon water supply system 100 may be sold as kit 440 comprising the following parts: at least one water reservoir interface 160; at least one at least one expandable plumbing assembly 180; at least one platform 200; and a set of user instructions 340. The kit has instructions such that functional relationships are detailed in relation to the structure of the invention (such that the invention can be used, maintained, or the like in a preferred manner). Five-gallon water supply system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 3:
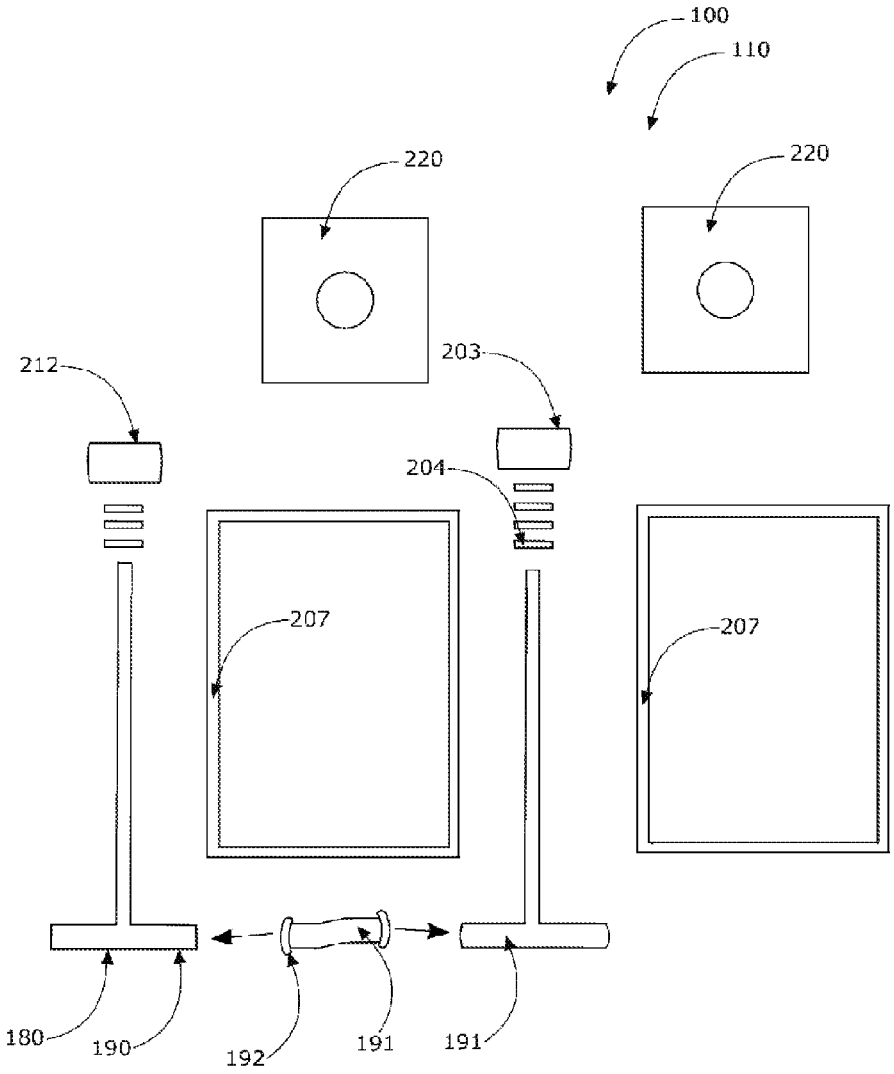
FIG. 3 is an exploded view illustrating the five-gallon water supply assembly according to an embodiment of the present invention of FIGS. 1-2.

Referring now to FIG. 3, an exploded view of five-gallon water supply system 100. Rectangular vertical-base 207 may have upper-platform 220 surface which may be configured in a square shape and sized to accommodate the outer circumference of standard 5-gallon drinking water bottles 175 (FIG. 2). Fourth water bottle stand 212 may be configured to support fourth water bottle 168 (FIG. 2). Last water bottle stand 203 may be configured to support last water bottle 170 at last elevation 224 (FIG. 2) with last riser 204. Further, at least one expandable plumbing assembly 180 may join to water-flow assembly 190, and water-flow assembly 190 may be configured of tubing 191 having threaded connections 192.

Figure 4:
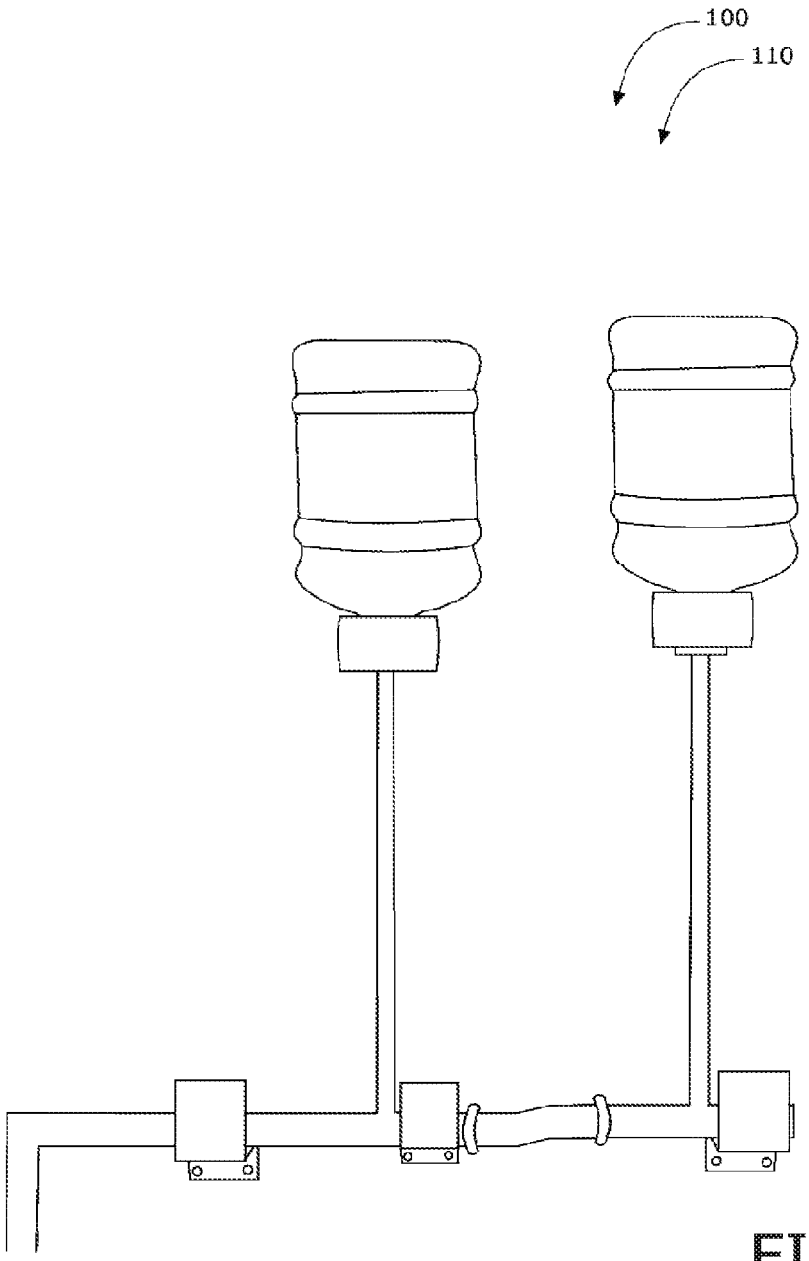
FIG. 4 is a perspective view illustrating the five-gallon water supply assembly according to an alternate embodiment of the present invention of FIGS. 1-3.

Referring now to FIG. 4, showing an alternative embodiment of an installation of five-gallon water supply system 100. Alternative embodiment for system for delivering water 110 may be configured to mount to a vertical planar surface with brackets. Upon reading this specification, it should be appreciated that, under appropriate circumstances, considering such issues as user preferences, design preference, structural requirements, marketing preferences, cost, available materials, technological advances, etc., other five-gallon water supply system arrangements such as additional water bottle stand configurations and materials, water heating and cooling features, and vertical planar surface mounting arrangements, etc., may be sufficient.

Figure 5:
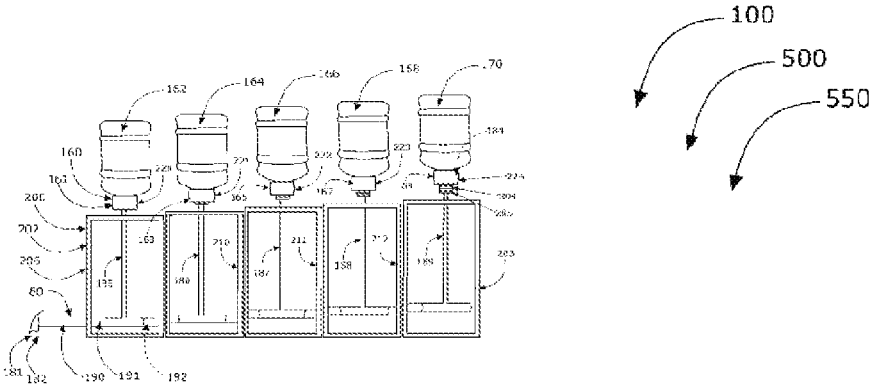
FIG. 5 is a flowchart illustrating a method of use for the five-gallon water supply assembly according to an embodiment of the present invention of FIGS. 1-4.
Figure 5:
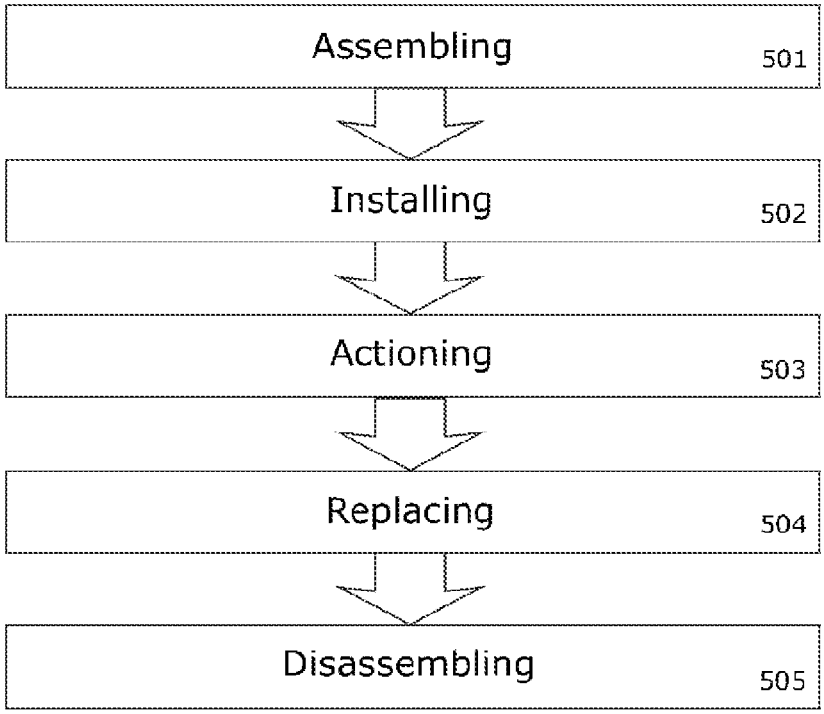

Referring now to FIG. 5 showing flowchart 550 illustrating method of use 500 for system 100 according to an embodiment of the present invention of FIGS. 1-4. As shown, method of use 500 may comprise the steps of: step one 501, assembling at least one water reservoir interface 160, at least one at least one expandable plumbing assembly 180, and at least one platform 200; step two 502, installing at least one 5-gallon water bottle 175; step three 503, actioning an electrically-powered on-demand pump 183 to transfer potable water to a distribution point for consumption; step four 504 replacing at least one 5-gallon water bottle 175 as desired; and step five 505, disassembling at least one water reservoir interface 160, at least one at least one expandable plumbing assembly 180, and at least one platform 200 as desired.

It should be noted that step 505 is an optional step and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A system for delivering water, the system comprising:

a first water reservoir interface configured to hydraulically couple with a first water bottle;

a last water reservoir interface configured to hydraulically couple with a last water bottle, the last water reservoir interface at a higher elevation than the first water reservoir interface;

an expandable plumbing assembly hydraulically coupled to the first water reservoir interface and to the last water reservoir interface, the expandable plumbing assembly configured to plumb potable water from the first water bottle and from the last water bottle to a single water outlet, said expandable plumbing assembly including an air vent, said air vent having a higher elevation than the last water reservoir interface; and a platform including a first water bottle stand removably coupled together with a last water bottle stand, the first water bottle stand configured to support the first water bottle at a first elevation, the last water bottle stand configured to support the last water bottle at a last elevation that is higher than the first elevation, wherein said last water bottle stand includes a basic stand and a last riser, said basic stand being substantially similar to the first water bottle stand, and said last riser configured to elevate the last water bottle by a last increment, said last increment being the difference between the last elevation and the first elevation.

2. The system of claim 1, further comprising:

a second water reservoir interface configured to hydraulically couple with a second water bottle, the second water reservoir interface at a higher elevation than the first water reservoir interface;

a third water reservoir interface configured to hydraulically couple with a third water bottle, the third water reservoir interface at a higher elevation than the second water reservoir interface; and a fourth water reservoir interface configured to hydraulically couple with a fourth water bottle, the fourth water reservoir interface at a higher elevation than the third water reservoir interface; and wherein the expandable plumbing assembly is also hydraulically coupled to the second water reservoir interface, to the third water reservoir interface, and to the fourth water reservoir interface, the expandable plumbing assembly further configured to plumb potable water from the second water bottle, from the third water bottle, and from the fourth water bottle to the single water outlet.

3. The system of claim 2, wherein said platform further includes a second water bottle stand, a third water bottle stand, and a fourth water bottle stand that are removably coupled together and to the first water bottle stand and to the last water bottle stand, the second water bottle stand configured to support the second water bottle at a second elevation, the third water bottle stand configured to support the third water bottle at a third elevation, and the fourth water bottle stand configured to support the fourth water bottle at a fourth elevation.

4. The system of claim 3 wherein said platform is configured to hold five standard 5-gallon water bottles in a single line.

5. The system of claim 2 wherein said single water outlet is configured to interface with a drain to provide an exit point to release said potable water from said at least one expandable plumbing assembly.

6. The system of claim 5 wherein said drain is configured with an electrically-powered on-demand pump to transfer said potable water to a distribution point for consumption.

7. The system of claim 1 wherein the first water bottle and the last water bottle are standard 5-gallon drinking water bottles.

8. The system of claim 1 wherein said platform further comprises a plurality of adjustable legs forming a rectangular vertical-base can be lengthened or shortened to provide a level surface.

9. The system of claim 1 wherein said rectangular vertical-base has an upper-platform surface configured in a square shape and sized to accommodate the outer circumference of standard 5-gallon drinking water bottles.

10. The system of claim 9 wherein said rectangular vertical-base is configured at least partially of durable metal materials capable of bearing substantial weight.

11. The system of claim 1 wherein said expandable plumbing assembly has a first interconnecting tube joining said first water reservoir interface to a water-flow assembly.

12. The system of claim 11 further comprising:

a second interconnecting tube joining said second water reservoir interface to said water-flow assembly;

a third interconnecting tube joining said third water reservoir interface to said water-flow assembly;

a fourth interconnecting tube joining said fourth water reservoir interface to said water-flow assembly; and a last interconnecting tube joining said last water reservoir interface to said water-flow assembly.

13. The system of claim 1 wherein a water-flow assembly has a lower elevation at said single water outlet and a higher elevation at said last water bottle stand.

14. The system of claim 1 wherein a water-flow assembly is configured of tubing having threaded connections.

15. The system of claim 1 wherein said system for delivering water is configured to mount to a vertical planar surface.

16. A system for delivering water comprising:

a first water reservoir interface configured to hydraulically couple with a first water bottle;

a last water reservoir interface configured to hydraulically couple with a last water bottle, the last water reservoir interface at a higher elevation than the first water reservoir interface;

an expandable plumbing assembly hydraulically coupled to the first water reservoir interface and to the last water reservoir interface, the expandable plumbing assembly configured to plumb potable water from the first water bottle and from the last water bottle to a single water outlet, said expandable plumbing assembly including an air vent, said air vent having a higher elevation than the last water reservoir interface; and a platform including a first water bottle stand removably coupled together with a last water bottle stand, the first water bottle stand configured to support the first water bottle at a first elevation, the last water bottle stand configured to support the last water bottle at a last elevation that is higher than the first elevation, wherein said last water bottle stand includes a basic stand and a last riser, said basic stand being substantially similar to the first water bottle stand, and said last riser configured to elevate the last water bottle by a last increment, said last increment being the difference between the last elevation and the first elevation;

wherein said second water reservoir interface configured to hydraulically couple with said second water bottle, the second water reservoir interface is at a higher elevation than said first water reservoir interface; a third water reservoir interface is configured to hydraulically couple with a third water bottle, said third water reservoir interface is at a higher elevation than said second water reservoir interface; and a fourth water reservoir interface configured to hydraulically couple with a fourth water bottle, said fourth water reservoir interface at a higher elevation than said third water reservoir interface;

wherein the expandable plumbing assembly is also hydraulically coupled to the second water reservoir interface, to the third water reservoir interface, and to the fourth water reservoir interface, the expandable plumbing assembly further configured to plumb potable water from the second water bottle, from the third water bottle, and from the fourth water bottle to the single water outlet;

wherein said platform further includes a second water bottle stand, a third water bottle stand, and a fourth water bottle stand that are removably coupled together and to the first water bottle stand and to the last water bottle stand, the second water bottle stand configured to support the second water bottle at a second elevation, the third water bottle stand configured to support the third water bottle at a third elevation, and the fourth water bottle stand configured to support the fourth water bottle at a fourth elevation;

wherein the first water bottle and the last water bottle are standard 5-gallon drinking water bottles;

wherein said platform further comprises a plurality of adjustable legs forming a rectangular vertical-base can be lengthened or shortened to provide a level surface;

wherein said single water outlet is configured to interface with a drain to provide an exit point to release said potable water from said plumbing assembly;

wherein said drain is configured with an electrically-powered on-demand pump to transfer said potable water to a distribution point for consumption;

wherein said rectangular vertical-base has an upper-platform surface configured in a square shape and sized to accommodate the outer circumference of the standard 5-gallon drinking water bottles;

wherein said platform is configured to hold the standard 5-gallon water bottles in a single line;

wherein said rectangular vertical-base is configured at least partially of durable metal materials capable of bearing substantial weight;

wherein said expandable plumbing assembly has a first interconnecting tube joining said first water reservoir interface to a water-flow assembly;

wherein said second interconnecting tube joins said second water reservoir interface to said water-flow assembly, a third interconnecting tube joins said third water reservoir interface to said water-flow assembly, a fourth interconnecting tube joins said fourth water reservoir interface to said water-flow assembly, and a last interconnecting tube joins said last water reservoir interface to said water-flow assembly;

wherein said water-flow assembly has a lower elevation at said single water outlet and a higher elevation at said last water bottle stand, and wherein said water-flow assembly is configured of tubing having threaded connections.

17. The system of claim 16 further comprising a kit including:

said at least one water reservoir interface;

said at least one expandable plumbing assembly;

said at least one platform; and a set of user instructions.

* * * * *